United States Patent [19]

Tsuchiya et al.

[11] Patent Number: 5,056,181

[45] Date of Patent: Oct. 15, 1991

[54] ROTARY BRUSH

[75] Inventors: Toshihiro Tsuchiya; Tomoharu Mitsunari, both of Chiba; Mitsuaki Noguchi, Saitama, all of Japan

[73] Assignee: Kabushiki Kaisha Hoky, Chiba, Japan

[21] Appl. No.: 412,141

[22] Filed: Sep. 25, 1989

[30] Foreign Application Priority Data

Oct. 13, 1988 [JP] Japan ..... 63-258095

[51] Int. Cl.[5] ..... A47L 13/36

[52] U.S. Cl. ..... 15/230.16; 15/41.1; 15/141.2; 15/179; 428/465; 428/466; 428/476.3

[58] Field of Search ..... 15/41.1, 43, 48.2, 141.2, 15/159 A, 179, 182, 188, 230.16, 383, 384; 428/465, 466, 476.3; 99/348; 366/369, 312, 313

[56] References Cited

U.S. PATENT DOCUMENTS

| | | | |
|---|---|---|---|
| 1,370,256 | 3/1921 | Adams | 15/182 |
| 1,422,100 | 7/1922 | Hoff | 15/188 |
| 3,327,339 | 6/1967 | Lemelson | 15/159 A |
| 3,402,416 | 9/1968 | Shaw et al. | 15/182 |
| 3,871,139 | 3/1975 | Rands | 15/159 A |
| 4,144,610 | 3/1979 | Moore et al. | 15/159 A |
| 4,367,564 | 1/1983 | Holley | 15/159 A |
| 4,480,350 | 11/1984 | White | 15/159 A |
| 4,696,380 | 3/1987 | Kobayashi et al. | 15/43 |
| 4,811,447 | 3/1989 | Everson | 15/159 A |

FOREIGN PATENT DOCUMENTS

| | | | |
|---|---|---|---|
| 2135869 | 9/1984 | United Kingdom | 15/41.1 |

*Primary Examiner*—Philip R. Coe
*Assistant Examiner*—Mark Spisich
*Attorney, Agent, or Firm*—Kinzer, Plyer, Dorn, McEachran & Jambor

[57] ABSTRACT

In a rotary brush wherein the surface of a rotating basic shaft has mounted thereto at least one flexible blade, the surface of the blade made of rubber or a thermoplastic elastomer as its base material and which stands face to face with a surface to be cleaned is covered with a plastic material having wear resistance and slipperiness.

8 Claims, 4 Drawing Sheets

ROTARY BRUSH

BACKGROUND OF THE INVENTION

1. Field of the Invention

This invention relates to a rotary brush, and particularly to a rotary brush for a cleaner having at least one flexible blade extending perpendicularly with respect to the axis or rotation thereof and operates to sweep up dust as a result of abutting of the blade upon a surface to be cleaned.

2. Description of the Related Art

Heretofore, a bristle type rotary brush wherein bristles are fixed around a rotating basic shaft has been used as a rotary brush for cleaners. There has been, however, such a problem that bristles are wound or twined with pieces of thread, cotton and the like (hereinafter referred to simply as "waste threads"). In order to solve the problem, the present applicant has proposed a rotary brush of a blade type by which winding or twining of waste threads is prevented and which is disclosed in Japanese Patent Publication No. 35246/1988. This rotary brush described in Patent Publication No. 35246/1988 is constructed in such a way that the surface of the rotating basic shaft has at least one flexible blade extending perpendicularly with respect to the axis of rotation thereof, the extreme edge portion of a blade, i.e. the portion standing face to face with a surface to be cleaned being provided with innumerable minute projections. These projections are for improving capability of collecting minute dust particles. For the sake of satisfying a requirement of flexibility and wear resistance in a material to be used, vulcanized rubber (hereinafter referred to simply as "rubber") has been used.

However, although such blades as described above have no problem in the case where they are used in a low speed rotation zone (around 1000 rpm) for a manual cleaner, there have been the following three problems in a high speed rotation zone (3000–6000 rpm) as in a vacuum cleaner. Namely, they are:

(1) Wearing of the blades is remarkable.

Particularly, the innumerable minute projections provided for improving capability of collecting minute dust wear easily so that capability of collecting dust becomes inferior. The present applicant has made various experiments in respect of respective brands of rubber and thermoplastic elastomeric materials. As a result, even a material having the highest wear resistance exhibits such life being half or less than that of the rotary brush of a bristle type, besides the cost therefor is several times higher than that of conventional blades. Thus, results of the experiment were quite unsatisfactory.

(2) Pile yarn in a loop carpet is damaged.

Since rubber has generally high wear resistance, such rubber functions so as to comb the pile yarn of a carpet in the case where the carpet is rubbed with a rotary brush of rubber blade type. As a result, there appears fuzzing of the pile yarn which damages feeling of the carpet.

(3) As a result of cleaning by the use of the rotary brush described above, a floor surface is stained black by rubbing the same with the blades.

This is because carbon black which has been incorporated in rubber for elevating various physical properties transfers to the floor surface as a result of rubbing the same with the blades of the above described rotary brush.

OBJECTS AND SUMMARY OF THE INVENTION

It is an object of the present invention to solve the above described problems involved in the prior art.

Namely, an object of the invention is to prevent wearing of blades, thereby providing a rotary brush having good durability.

Another object of the present invention is to provide a rotary brush which is inexpensive in manufacturing cost by the use of an inexpensive material.

A further object of the present invention is to provide a rotary brush which does not damage the surface of a carpet to be cleaned.

A still further object of the present invention is to provide a rotary brush which does not stain black the surface of a floor to be cleaned due to rubbing with blades of the rotary brush.

A basic principle of a method for attaining the above described objects is to cover the surface of a blade prepared from rubber or a thermoplastic elastomer as its base material at least a part of the blade which will rub against the surface of a floor with a plastic material having good wear resistance and exhibiting a low coefficient of friction when in contact with typical floor materials, in other words having high "slipperiness" and which is represented by "nylon 6".

More specifically, it is well known that nylon is a material having both wear resistance and slipperiness in general. Such nylon is far superior in this respect to rubber or thermoplastic elastomers. Since nylon is a rigid material, it cannot afford the flexibility which is required of blade if used alone. A thermoplastic elastomeric material is known which is prepared incorporating a rubber polymer being obtained by copolymerizing, for example, amorphous polymers into, for example, nylon as its base in order to afford rubber elasticity thereto. However, such a thermoplastic elastomer exhibits intermediate physical properities between those of rubber and nylon in terms of wear resistance and slipperiness so that it too cannot sufficiently overcome the disadvantages involved in known types of blade.

On the basis of the technical background as described above, the present invention has been constructed such that rubber or a thermoplastic elastomer is used as the base material for a blade in order to afford flexibility and bending characteristic thereto, whilst the surface which will rub against a floor in use is covered with a plastic material such as nylon or the like having wear resistance and slipperiness.

Since the covering material made of a plastic material such as nylon and the like is rigid so that the same is hard to bend as mentioned above, it is required to make the covering material thin up to such a degree where the base material of a blade is not so affected in its flexibility and bending characteristic.

According to the above described construction, the problems are solved as follows.

(1) Wear resistance is significantly improved owing to the fact that a portion of a blade which rubs directly the surface of a floor may be made from nylon and the like.

Under the circumstances, the base material does not necessarily require wear resistance so that rubber or thermoplastic elastomer for general use can be used. Accordingly, the blade can be manufactured inexpensively even if the above-mentioned covering process is taken into consideration.

(2) Since the rubbing surface has slipperiness, frinctional resistance with respect to a surface to be cleaned becomes small. This means not only prevention of damaging a loop carpet, but also improvement of wear resistance in the blade.

(3) Since a base material in the blade is not in direct contact with the floor surface, carbon black blended in the rubber does not transfer to the floor surface and thus, the floor surface is not stained with the carbon black.

As described above, the construction of a blade according to the present invention is derived from a combination of a material such as nylon and the like having excellent wear resistance and slipperiness and another material of rubber such as NBR (acrylonitrile-butadiene copolymer rubber) having excellent pliably bending characteristic and elasticity. In other words, the present invention directs synergies obtained by combining two materials having extremely different properties from each other as described above. Hence, blades of the rotary brush according to the present invention posses, characteristic features of both the materials, i.e. particularly, wear resistance as well as elasticity without offsetting them mutually.

BRIEF DESCRIPTION OF THE DRAWINGS

Embodiments of the invention will now be described, by way of examples with reference to the accompanying drawings, in which.

DETAILED DESCRIPTION OF PREFERRED EMBODIMENTS

Figure 1:
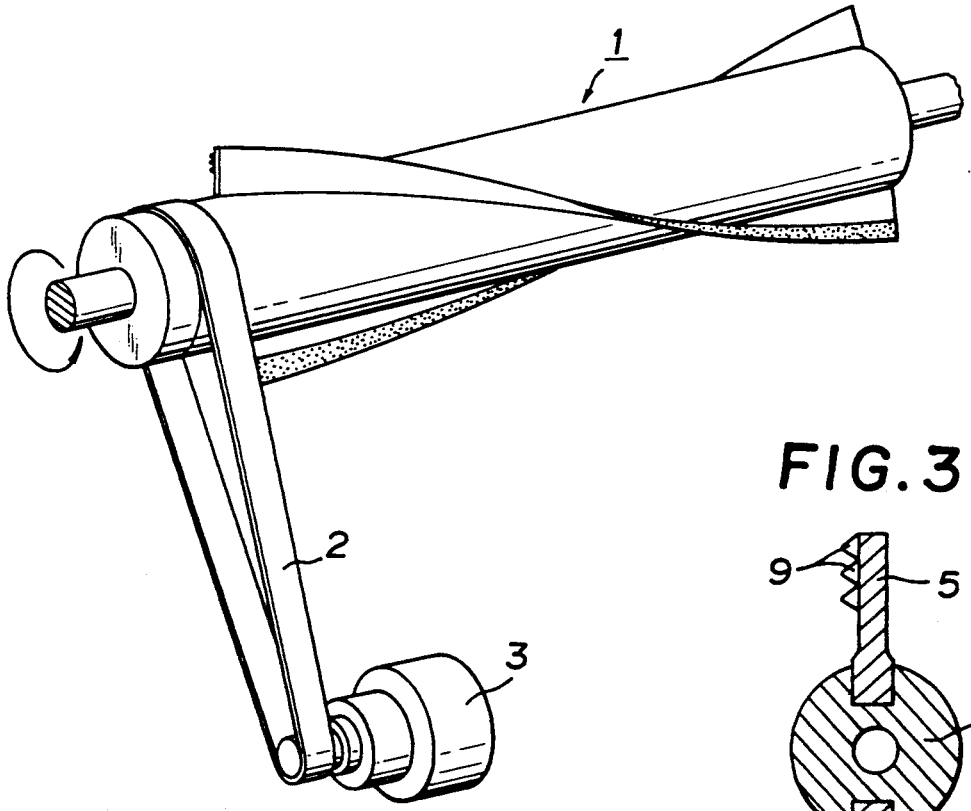
FIG. 1 is a perspective view schematically showing a rotary brush according to the present invention as it would be installed in the inlet port of a vacuum cleaner.
Figure 3:
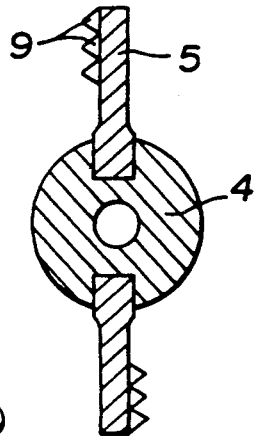
FIG. 3 is an enlarged schematic side view, in section, showing minute projections on the rotary brush of FIG. 2.
Figure 2:
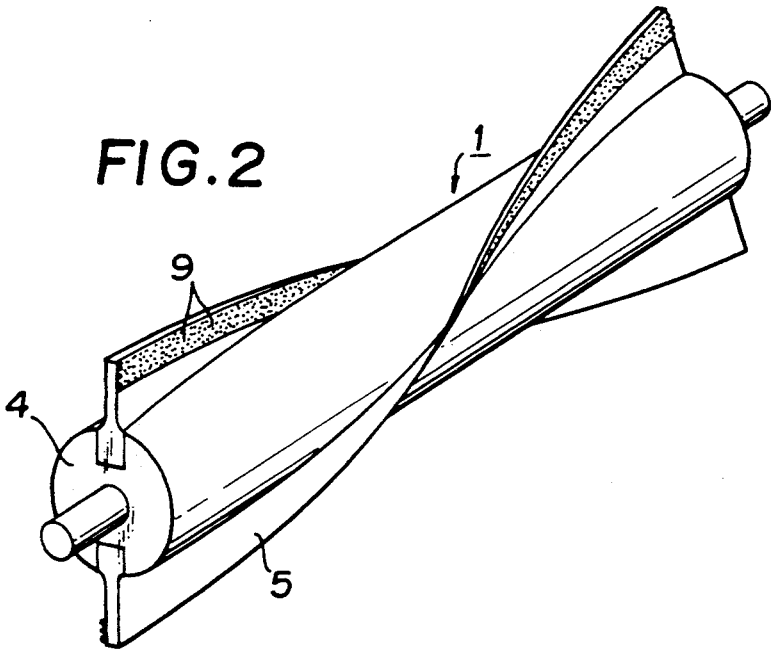
FIG. 2 is a general perspective view showing the rotary brush according to the first embodiment of the invention.

Embodiments of the rotary brush according to the present invention will be described in detail hereinbelow by referring to the accompanying drawings.

EXAMPLE 1

FIGS. 1–4 show the first embodiment of the present invention wherein a rotary brush 1 and a motor 3 driving the rotary brush 1 through a belt 2 are mounted in an inlet port of a vacuum cleaner (not shown). The rotary brush 1 comprises flexible blades 5 arranged around the cylindrical surface of a rotating basic shaft 4 and extending perpendicular to the rotary axis.

Figure 4:
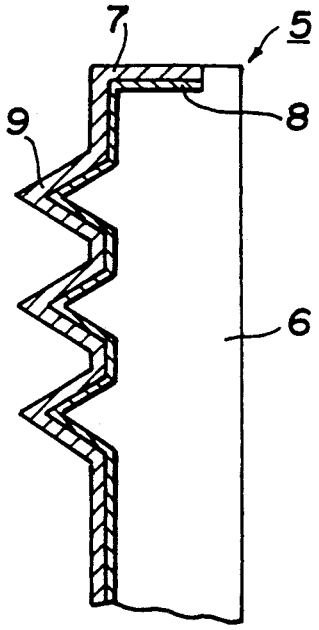
FIG. 4 is an enlarged detailed side sectional view showing an essential part of a blade shown in FIG. 3 according to the first embodiment of the invention.

FIG. 4 shows a section of a blade according to the present invention wherein a base material 6, a covering material 7 and an adhesive 8 are made of NBR, nylon and a rubber adhesive (the details of which will be described later), respectively. Furthermore, minute projections 9 are defined on the extreme edge portion of the blade on the side whose surface will rub against the surface of a floor to be cleaned in use, for improving capability of collecting minute dust.

Next, a method for manufacturing a blade having the construction as described above will be described.

Figure 6:
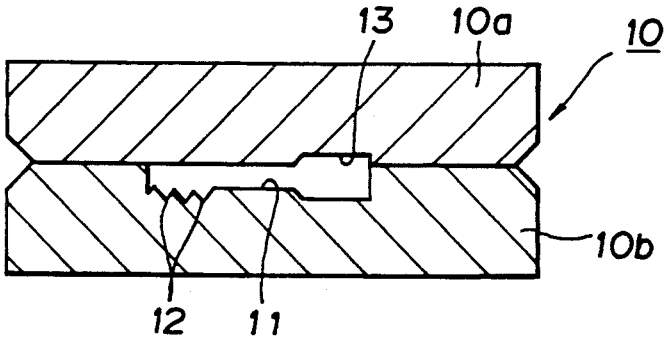
FIG. 6 is a schematic side sectional view showing a metallic mold.
Figure 7:
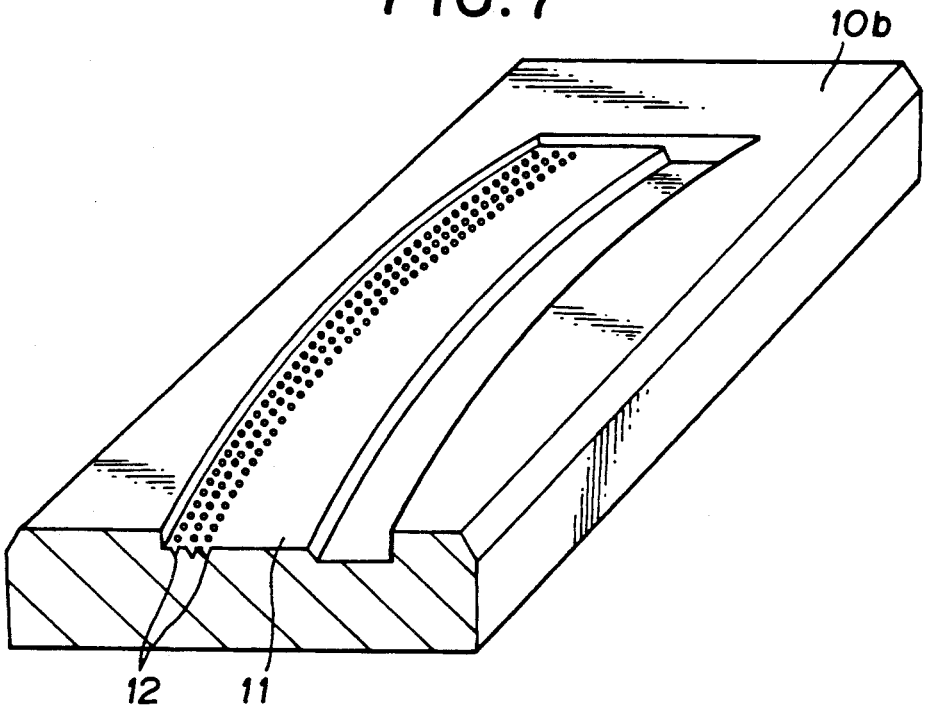
FIG. 7 is a cutaway perspective view showing one half of the mold of FIG. 6.
Figure 8:
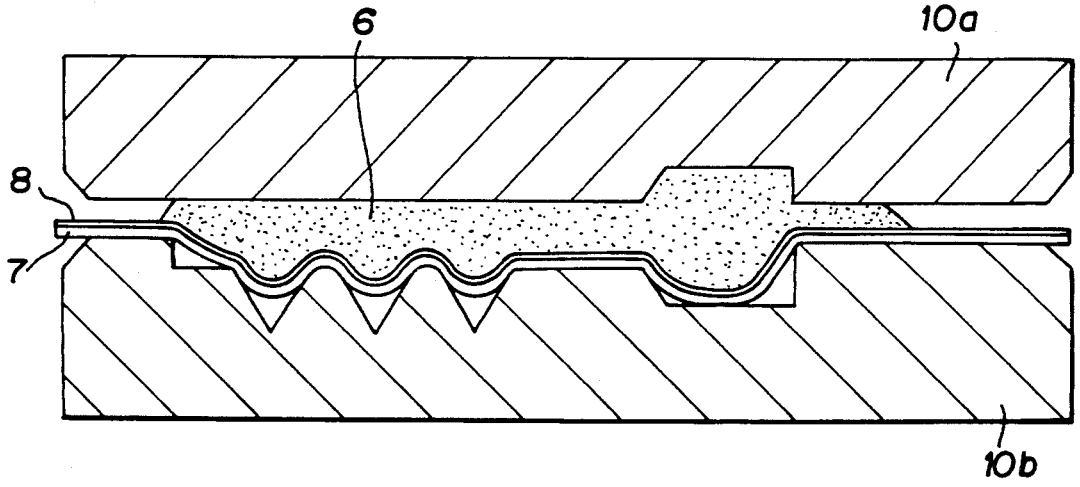
FIG. 8 is an explanatory view illustrating a method for molding blades according to the present invention.

FIG. 6 is a sectional view showing a metallic mold 10 of steam platen press type, and FIG. 7 is a perspective view showing the metallic mold portion **10*b* shown lowermost in FIG. 6 (hereinafter referred to as "lower mold"). In the lower mold 10*b* a concave part 11 for a molding a blade is defined, and small concave portions 12 for molding projections are defined on the end region of the concave part 11. Furthermore, a concave part 13 for molding a blade is also defined on a metallic mold portion 10*a* shown uppermost in FIG. 6 (hereinafter referred to as "upper mold"). In case of molding, as shown in FIG. 8, a nylon sheet which is the covering material 7 on which has been previously applied the adhesive 8 is placed on the upper surface of the lower mold 10*b* while keeping the surface of the adhesive 8 upward, raw rubber (unvulcanized rubber) which is the base material 6 is then disposed thereon, the upper mold 10*a* is set on the lower mold 10*b*, and these upper and lower molds 10*a* and 10*b* are pressed and heated. As a result of heating, the nylon sheet softens. The similarly softened raw rubber is fluidized so that it deforms the nylon by means of heating and pressing until a profile of the same coincides with that of the lower mold 10*b*. Since the adhesive 8 is a rubber adhesive of a pressure- and heat-sensitive type, bonding between the rubber and the nylon is completed during this process, whereby the blade having a profile as shown in FIG. 4** is obtained.

Thus, the nylon can be molded and bonded at the same time by utilizing heat and pressure required for vulcanizing rubber.

A condition under which the molding method as described above can be carried out is such that the heat in case of vulcanizing rubber does not fuse completely the covering material, but must maintain a temperature at which the covering material is properly softened. Fortunately, resin sheets suitable for the covering material including nylon as well as polyacetal, polyethylene and the like satisfy requisites for the above described condition and accordingly, the covering material is not necessarily limited to nylon sheet in the present invention.

According to this procedure, it is not required that the covering material has been previously molded in a predetermined shape, but a mere sheet material is applicable so that it is very advantageous from the viewpoint of cost.

While such a blade which is prepared by molding integrally a rubber blade base material and a nylon sheet on a side of which has been applied a rubber adhesive in accordance with a steam platen press method has been described in the present example, the present invention is not limited thereto. More specifically, the blade can be also manufactured in such a manner that a nylon sheet on a side of which had been applied a rubber adhesive has been previously secured into a metallic mold, a thermoplastic elastomer is injected thereto, thereby molding integrally the nylon sheet and the thermoplastic elastomer in accordance with injection molding method.

Although a usual rubber adhesive exhibits ordinary advantages as an adhesive used in the above methods, there is a fear of cracks appearing in a part of a blade as a result of using the same for a long period of time, because repeated bending of a considerable number of times is required for the blade. Accordingly, such usual rubber adhesive as described above may not necessarily be sufficient for all applications.

As a function of the optimal adhesive for such use as described above, it is desirable that an adhesive layer has the same elasticity as that of a base material. It was found that such elasticity can be attained by the formulation to be described below. Namely, the formulation is such that a base material, unvulcanized rubber (unvulcanized NBR in Example 1) is dissolved in a ketone or mixed organic solvent consisting of ketone and aromatic types, and an isocyanate compound or a condensate of isocyanate and polyol or polyester is added to the solution. The reactive adhesive thus obtained has been applied to a nylon sheet and dried, and when the molding method as mentioned above is applied to the nylon sheet, a three-dimensional structure is formed in the adhesive layer so that the required elasticity is obtained. As a result, an ideal blade structure involving no appearance of cracks even in case of a repeated use for a long period of time can be obtained.

EXAMPLE 2

Figure 5:
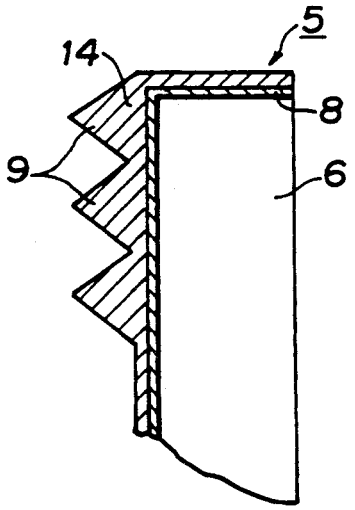
FIG. 5 is an enlarged side sectional view showing an essential part of a blade according to the second embodiment of the invention.

FIG. 5 shows a blade according to the second embodiment of the present invention which is prepared by adhesive-bonding a covering material 14 made of nylon and the like on either side of which have been previously formed innumerable projections to a surface of a base material 6 so as to rub against the surface of a floor to be cleaned in use. It is to be noted that the blade of the present embodiment is more expensive than that of Example 1 because the covering material has previously been molded. However, since all the minute projections on the extreme end of the blade where the wear is concentrated are made from nylon or the like, there is a merit particularly in that the blade can withstand even a hard use.

The adhesive-bonding procedure of this example may be effected in accordance with that of Example 1, but it is also possible to adhesive-bond the covering material 14 to the surface on a blade so as to rub against the surface of a floor to be cleaned in use after molding the base material 6.

EXAMPLE 3

Figure 9:
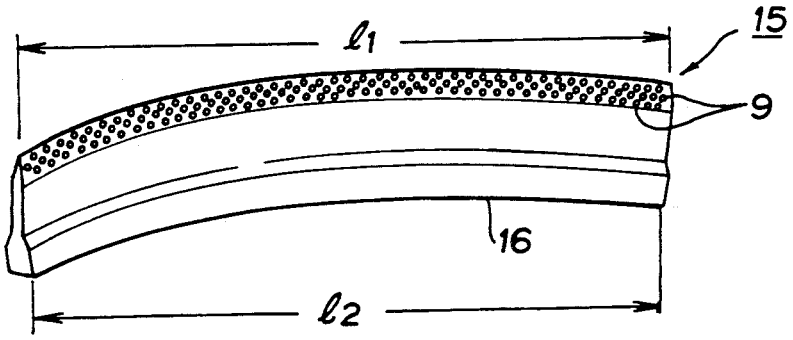
FIG. 9 is a perspective view showing a blade according to the third embodiment of the present invention.

FIG. 9 shows a blade 15 according to the third embodiment of the present invention which is suitable for use in the case where the blades 15 are mounted on the surface of a rotating basic shaft 4 of a rotary brush with respect to the axial direction thereof in a spiral manner. In the construction as described above, the blade 15 must be substantially fan-shaped from a theoretical point of view as shown in FIG. 9. More specifically, the whole length $l_1$ of the extreme edge portion of the blade 15 must be longer than that $l_2$ of the edge portion 16 to be attached to the shaft. In the case where blades are made from rubber or a thermoplastic elastomer alone as in prior art, even if the bottom portion has been manufactured straight and is attached to a rotating basic shaft, the extreme edge portion can extend easily so that there is practically no problem. In this respect, however, since the preferred covering material in used in the present invention hardly extends, it is difficult to mount the blades on the rotating basic shaft in an ideal configuration. Accordingly, a prescribed curvature has been previously given to the edge portion 16 of the blade 15 So that the blade 15 can be disposed along the curvature of the cylindrical surface of the rotating basic shaft 4, and hence the edge portion 16 of the blade 15 is formed in a circular arc profile. According to this pretreatment, the blades 15 can easily be wound around the rotating basic shaft 4, and this makes working for attaching the blades to the rotating basic shaft easy. Furthermore, because an excessive load is not applied to the blade 15 in the event of attaching the same to the rotating basic shaft 4, the blades 15 are not twisted or inclined.

The present invention has been constructed as described above and thus, the advantages as described hereinbelow are obtained.

Since the blades of the rotary brush according to the present invention have sufficient bending characteristic, the cleaning effect thereof is not inhibited. Besides since the surface of each blade which will be in contact with a surface to be cleaned is covered with a material having good slipperiness and wear resistance, damage of a carpet is prevented and at the same time, service life of the blade itself is prolonged.

Moreover, it is not required to use an expensive material as one for a base material of the blade, but an inexpensive material having general applicability such as NBR or polyurethane may be used so that remarkable reduction can be attained in the manufacturing cost.

While in the foregoing, preferred embodiments of the invention have been disclosed in considerable detail for purposes of illustration, it will be understood by those skilled in the art that many of these details may be varied without departing from the spirit and scope of the invention.

What is claimed is:

1. In a rotary brush, including a shaft and at least one flexible blade being mounted on a surface of said shaft, said blade comprising:

a base material made from rubber or other thermoplastic elastomer including a plurality of projections disposed on an extreme edge portion of said base material;

a thermoplastic covering having wear resistance and slipperiness, said covering being applied to at least one side surface of said base material which in use opposes a surface to be cleaned; and a heat-sensitive reactive type rubber adhesive disposed on a surface of said covering which is to be bonded to said base material.

2. A rotary brush according to claim 1, wherein said blade is mounted on said surface of said shaft in a spiral.

3. A rotary brush according to claim 2, wherein said blade is formed such that an edge portion of said blade is in contact with said shaft to define a circular arc profile therewith.

4. In a rotary brush, including a shaft and at least one flexible blade mounted on a surface of said shaft, said blade comprising a molding of:

a base material made from rubber or other thermoplastic elastomer including a plurality of projections disposed on one surface of said blade, said one blade surface defining a surface which rubs against a floor to be cleaned;

a thermoplastic covering having wear resistance and slipperiness; and a heat-sensitive reactive type adhesive for bonding said covering on a surface of said base material, said adhesive retaining elasticity when in a bonded state;

wherein the base material, covering and adhesive are bonded by heat and pressure to a predetermined shape.

5. In a rotary brush, including a shaft and at least one flexible blade being mounted on a surface of said shaft, said blade comprising:

an elongate base material made from rubber or thermoplastic elastomer including a plurality of projections defined on an extreme edge portion of said base material;

a laminated thermoplastic covering having wear resistance and slipperiness, disposed on at least one side surface of said base material and on said plurality of projections, said side surface during use being in an opposing relationship to a surface to be cleaned; and a heat-sensitive, reactive type rubber adhesive disposed adjacent a surface of said covering which is to be bonded to said one surface of said base material, said adhesive being disposed between said one surface of said base material and said covering.

6. A rotary brush as claimed in claim 5, wherein said blade is mounted on said surface of said shaft in a spiral.

7. A rotary brush as claimed in claim 6, wherein said blade in formed such that an edge portion of said blade, opposite said extreme edge portion of said base material, is in contact with said shaft and defines a circular arc profile therewith.

8. In a rotary brush, including a shaft and at least one flexible blade mounted on a surface of said shaft, said blade comprising a molding of:

an elongate base material made from rubber or thermoplastic elastomer including a plurality of projections defined on a surface of said blade which during use contacts against a surface to be cleaned;

a thermoplastic covering having wear resistance and slipperiness; and a heat-sensitive, reactive rubber type adhesive for bonding said covering on a surface of said base material, said adhesive being disposed between said base material and said covering and having elasticity in the bonded state wherein said base material, covering and adhesive are bonded by heat and pressure to a predetermined shape.

* * * * *